United States Patent [19]

Altherr et al.

[11] Patent Number: 4,466,546

[45] Date of Patent: Aug. 21, 1984

[54] BOTTOM SHELF COUPLER WITH ANTICREEP PROTECTION MEANS

[75] Inventors: Russell G. Altherr, Munster, Ind.; John W. Kaim, Chicago, Ill.

[73] Assignee: AMSTED Industries Incorporated, Chicago, Ill.

[21] Appl. No.: 371,590

[22] Filed: Apr. 26, 1982

[51] Int. Cl.[3] ..... B61G 3/24

[52] U.S. Cl. ..... 213/148; 213/146

[58] Field of Search ..... 213/142, 145, 146, 147, 213/148, 144, 153

[56] References Cited

U.S. PATENT DOCUMENTS

| | | | |
|---|---|---|---|
| 2,393,912 | 1/1946 | Kayler | 213/148 |
| 2,585,958 | 2/1952 | Metzger | 213/146 |
| 2,747,750 | 5/1956 | Wolfe | 213/148 |
| 3,549,022 | 12/1970 | Metzger | 213/148 |

*Primary Examiner*—Robert B. Reeves
*Assistant Examiner*—Glenn Foster
*Attorney, Agent, or Firm*—Fred P. Kostka

[57] ABSTRACT

This invention relates to a railway car coupler having an improved anticreep protection assembly so as to prevent inadvertent uncoupling during movement of the railway car along a track. The improvement comprises the provision of a chamfered locklift connector or a chamfered coupler structure that lies in the path of movement of the connector so that an anticreep prong of the connector may be free to engage with a front face ledge of the coupler head to provide positive anticreep protection against accidental unlocking of the coupler.

1 Claim, 9 Drawing Figures

BOTTOM SHELF COUPLER WITH ANTICREEP PROTECTION MEANS

BACKGROUND OF THE INVENTION

1. Field of Invention

The present invention relates to a railway car coupler and more particularly to a shelved coupler having an anticreep protection means operable to prevent accidental unlocking of the coupler during movement of a railway car along a track.

2. Prior Art

Conventional AAR Standard railway couplers generally have an articulated rotary locklift assembly to operate the locking mechanism of the coupler resulting from a torque applied to it by an operating rod. The articulate and rotary arrangement of the locklift assembly permits longitudinal translation as a result of longitudinal buff and draft forces occurring during the normal operation of the railway car. The mass inertia of the locklift assembly about its point of suspension can result in a vertical force to activate and release the lock. The locklift assembly is constructed and arranged to prevent accidental unlocking of the knuckle due to such inertia buff forces. This is generally accomplished by the provision of an anticreep prong structure in the locklift assembly to engage with a front face ledge of the coupler head positioned in the vertical path of movement of the anticreep prong so that vertical motion of the locklift assembly transmitted from the longitudinal forces occurring during car operation is stopped by the front face ledge and prevented to activate and release the locking mechanism.

A Standard railway coupler may include a bottom shelf means having a horizontal shelf depending below the knuckle so that the underside of a mating coupler knuckle may engage with the shelf to limit relative vertical movement between a mating coupler. This bottom shelf means is generally formed on a wall depending downwardly from the underside of the front face of the coupler. A vertical portion of the wall may lie in the path of longitudinal movement of a locklift assembly laterally displaced due to a bent, worn or a damaged operating rod mechanism so that the anticreep prong fails to engage with the front face ledge. Failure to provide anticreep protection may result in the transmission of longitudinal inertia forces to vertical forces which activate and release the locking mechanism thereby causing inadvertent uncoupling.

Representative but non exhaustive of anticreep protection device relating to couplers are U.S. Pat. Nos. 3,114,461 and 3,572,518.

SUMMARY OF THE PRESENT INVENTION

By the present invention, it is proposed to provide an improved railway car coupler which overcomes the difficulties encountered heretofore.

This is accomplished generally by the provision of a chamfered portion along one of the wall of the bottom shelf or the locklift assembly in the area of interference so as to permit engagement of the anticreep prong with the front face ledge.

In one embodiment of the invention, one of the vertical wall portion or a portion of the locklift assembly is chamfered, or beveled in the area of interference so that the locklift assembly is free to seek its own path of movement.

In another embodiment of the invention, a vertically extending and rearwardly projecting rib is formed to provide a chamfered or beveled ledge in the area of interference so that the locklift assembly is guided by the chamfered or beveled ledge to engage the anticreep prong with the front face ledge.

DESCRIPTION OF THE PREFERRED EMBODIMENT

Figure 2:
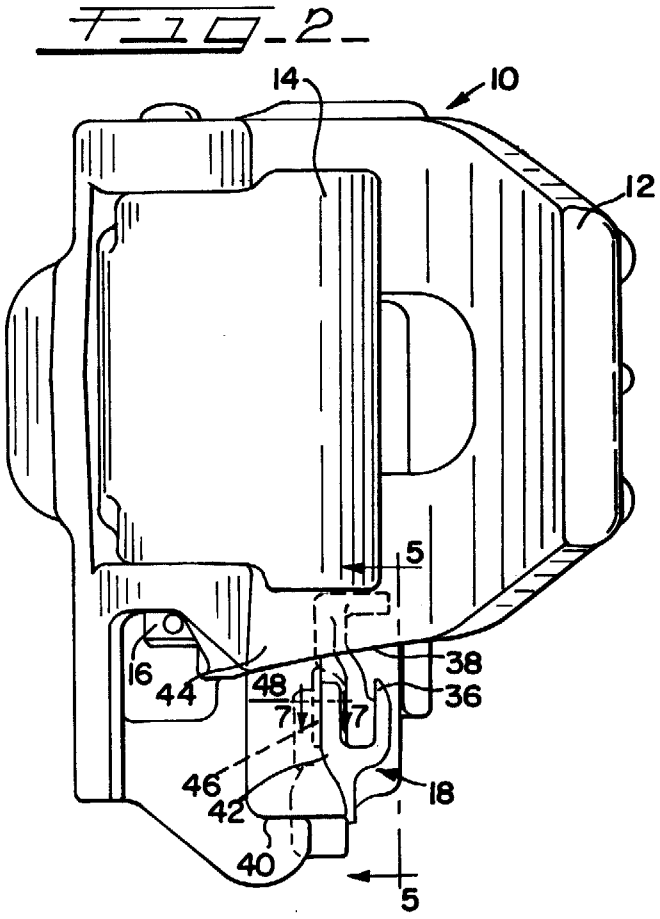
FIG. 2 is a front elevational view of the coupler head showing the locklift assembly in a laterally displaced position.
Figure 1:
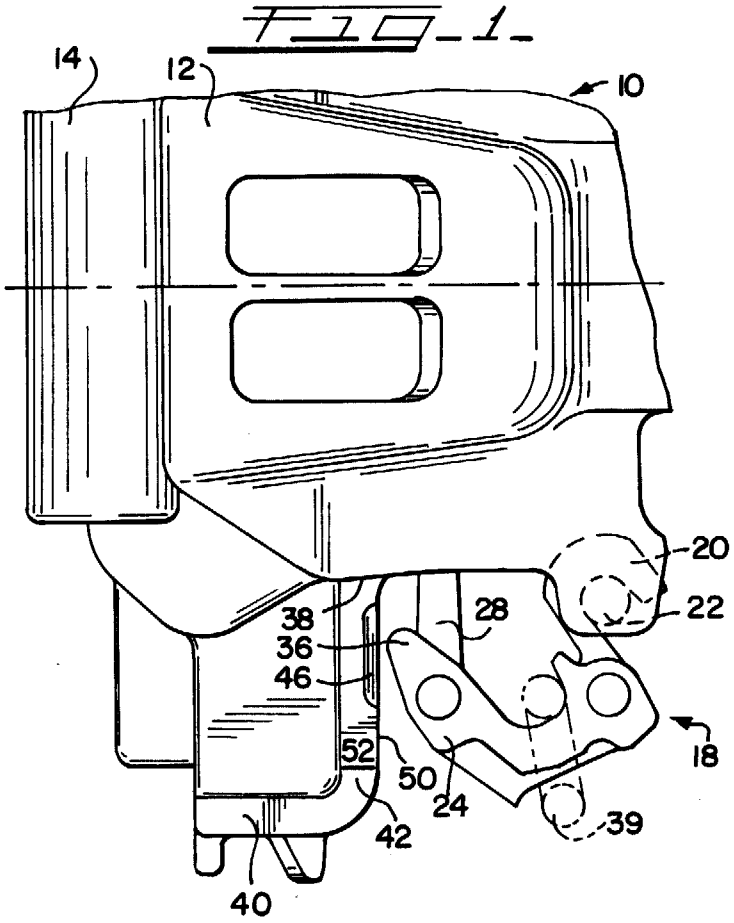
FIG. 1 is a partial and side elevational view of a coupler head having a bottom shelf embodying one of the structures of the invention.

Referring now to FIGS. 1 and 2, there is shown a coupler head 10 embodying the structure of the invention. Coupler head 10 includes a forwardly projecting guard arm 12 laterally spaced from a knuckle 14. Knuckle 14 is supported by head 10 and pivotable about a vertically disposed pivot pin 16 between its thrown position (not shown) and its locked position (FIGS. 1 and 2). Movable with knuckle 14 toward its locked position is a knuckle thrower (not shown) positioned inside coupler head 10. A lock 35 (shown in FIGS. 5 and 6) is cooperatively associated with the knuckle thrower within head 10 in a conventional manner. A locklift assembly 18 is positioned below the coupler head and associated with head 10 and lock 35 to operate the lock between its locked, released and an intermediate lockset position.

Figure 3:
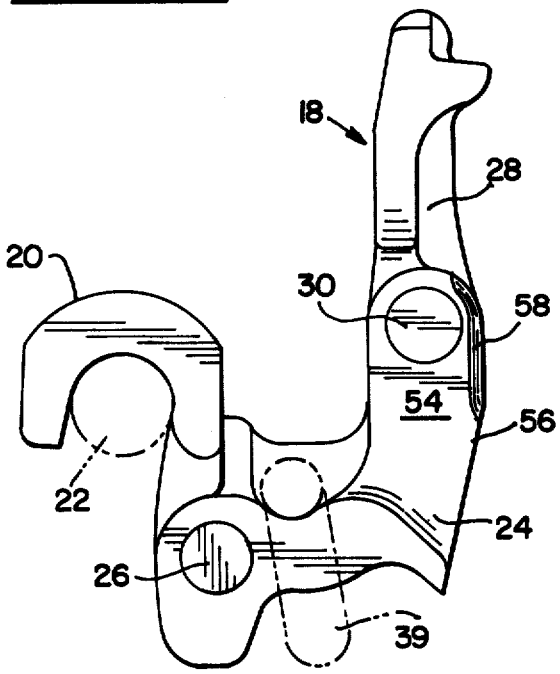
FIG. 3 is a side elevational view of a locklift assembly embodying another structure of the invention.
Figure 4:
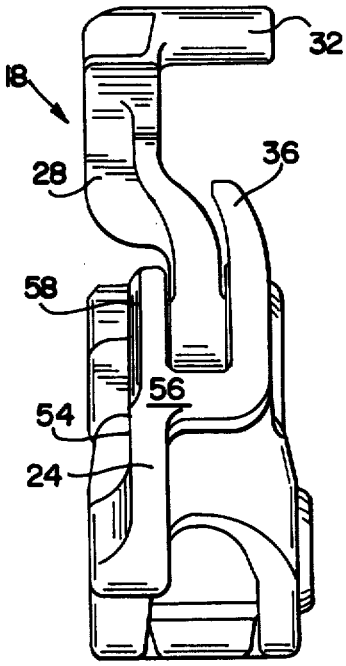
FIG. 4 is a front elevational view of the locklift assembly in FIG. 3.
Figure 5:
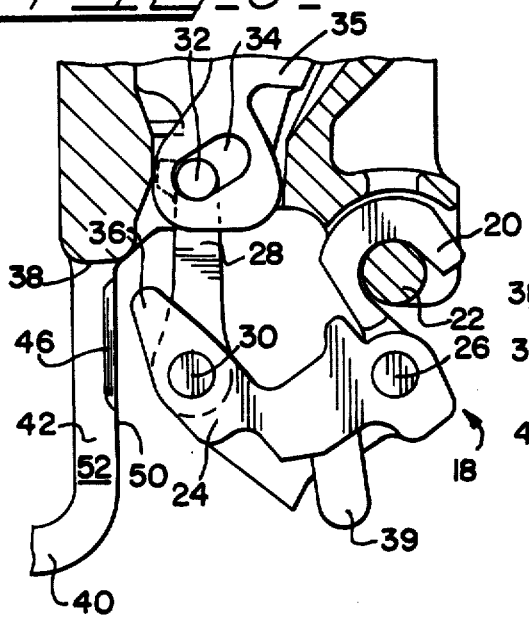
FIG. 5 is a partial and side sectional view of the coupler head of FIG. 2 along line 5—5; showing the locklift assembly in a free hanging position.
Figure 6:
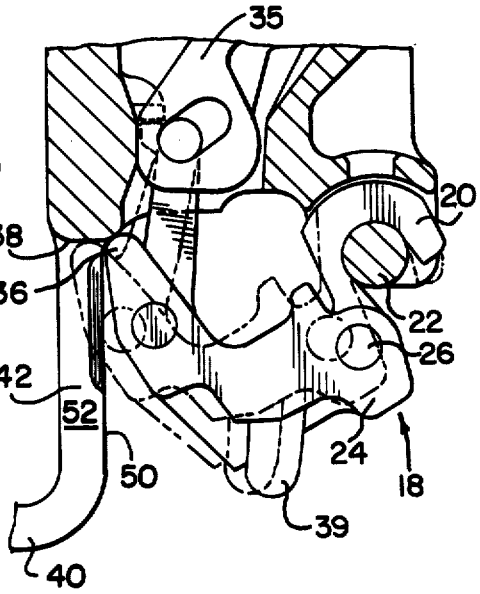
FIG. 6 shows, in solid lines, the position of the locklift assembly with its anticreep prong engaging with the front face ledge, and in phantom lines, the position of the locklift assembly under longitudinal shock forces.

As best illustrated in FIGS. 3 and 4, locklift assembly 18 includes a J-shaped hook 20 rotatably mounted to a transversly extending rotary shaft 22 (FIGS. 5 and 6) located at a lower portion of coupler head 10. A connector 24 having a longitudinally extending body is pivotally connected to hook 20 by rivet 26 at one end and a vertically projecting toggle 28 pivotally connected to the other end by rivet means 30. A laterally projecting lock slot trunnion 32 is formed at the end of toggle 28 to be disposed in a toggle slot 34 of the lock 35 as defined in the lower portion of the lock 35 (FIG. 5).

A portion of an operating rod 39 is releasably mounted intermediate the ends of the body of connector 24 so that a rotational movement of operating rod 39 causes connector 24 to rotate about rotary shaft 22 of the lower portion of coupler head 10.

The movement of the lock from a locked to a lockset position requires the rotation of the locklift assembly 18 about rotary shaft 22 so that lock slot trunnion 32 of toggle 28 may advance vertically within lock slot 34 and lift lock vertically to its lockset position.

The forward end of connector 24 includes a longitudinally projecting arm integrally formed with the body to define an anticreep prong 36. Anticreep prong 36 is free to travel in a vertical direction when operating rod 39 rotates connector 24 to release the lock.

It should be noted that the lock should be moved to its lockset position only when it is desired to open the knuckle. In order to prevent inadvertent movement of this nature as a result of longitudinal forces under normal operating conditions, a front face ledge 38 positioned adjacently to and perpendicular to a front face of the coupler, acts as a stop for anticreep prong 36 to prevent transmission of vertical and longitudinal forces that result in placing the lock in a lockset position. Thus it will be seen that only deliberate movement of the locklift assembly 18 will position lock in its lockset position. During normal operation of the locklift assembly 18, as an anticreep protection device, it is subject to lateral displacement due to a certain amount of tolerance inherent in the manufacture of its component parts, and lateral coupler angling towards the guard arm side restricted by a damaged or worn operating rod 39. The bottom shelf structure of a coupler may lie in the path of longitudinal movement of the anticreep means when the locklift assembly 18 is laterally displaced toward the knuckle side of the coupler due to a bent or damaged connecting operating rod 39. The present invention provides an anticreep protection means to insure the proper engagement of the prong and the front face ledge when the locklift assembly is laterally displaced.

In FIGS. 1 and 2, a horizontal bottom shelf 40 is shown depending from coupler head 10 below knuckle 14 for engagement with the underside of the knuckle of a mating coupler (not shown) so as to limit relative vertical movement of the couplers. A wall 42 of sufficient thickness is extended downwardly from coupler head front face 44 to provide structural support for the horizontal bottom shelf 40. It can be seen in FIG. 2 that support wall 42 is recessed laterally without adversely affecting the structural strength of the support wall and to provide clearance for the longitudinal movement of the connector 24 of a normal and operable locklift assembly 18. However, where the locklift assembly 18 is laterally displaced toward the knuckle side due to tolerance of parts or damaged or worn operating rod or the like, wall 42 may lie in the path of longitudinal movement of the locklift assembly and prevent the engagement of anticreep prong 36 with front face ledge 38.

Figure 7:
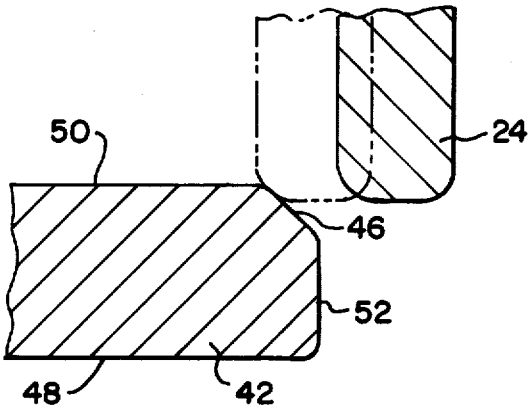
FIG. 7 is a sectional and fragmentary view of the coupler head of FIG. 2 along line 7—7.

In order to permit the engagement of a laterally displaced anticreep prong with the front face ledge of the coupler head, one embodiment of the invention provides for a chamfered or beveled vertical edge 46 along the upper portion of the rear edge of shelf support wall 42 to allow connector 24 to move unobstructively in its longitudinal path. FIG. 7 shows connector 24 at a free hanging position in solid line; and its laterally disposed position in phantom lines. Shelf support wall 42 includes a front face 48 opposite a rear face 50 and adjoined by a side face 52 facing the guard arm of the coupler. In practice, it has been found that the chamfering of ¼ inch from rear face 50 and side face 52 of shelf support wall 42 along the rear edge at an angle of inclination of 45° with the longitudinal axis of the coupler head is preferable, and will provide the necessary clearance for the engagement of anticreep prong 36 with front face ledge 38. However, it should be understood that any angle of inclination is satisfactory which provides clearance for connector 24 to move freely in its path. As a result, anticreep prong 36 of connector 24 engages front face ledge 38 during buff or draft forces to provide a positive anticreep protection against inadvertent uncoupling.

Figure 9:
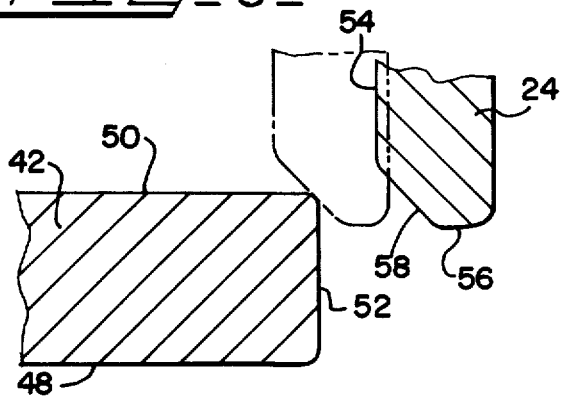
FIG. 9 is a sectional and fragmentary view of the coupler head embodying an alternate structure of the embodiment shown in FIG. 7.

In FIG. 9, there is shown a second embodiment of the invention. A partial structure of connector 24 is shown having a side face 54 toward the knuckle and adjoined to front face 56. Approximately a ¼ inch is chamfered from side face 54 and front face 56 to form a beveled edge 58 at an angle of inclination of 45° with the longitudinal axis of the coupler head. The beveled edge 58 may contact with shelf support wall 42 when connector 24 is at its most lateral position, shown in phantom lines, so that connector 24 may be guided by shelf support wall 42 to move freely in a longitudinal direction. As a result, anticreep prong 36 of connector 24 may engage front face ledge 38 to provide a positive anticreep protection against inadvertent uncoupling.

It should be apparent that the shelf support wall 42 as well as the connector 24 may be chamfered to provide the necessary clearance for an unobstructed moving connector. This has the advantage of reducing the amount of chamfer to each of wall 42 and connector 24, and still provide the positive anticreep protection against inadvertent uncoupling as disclosed heretofore.

Figure 8:
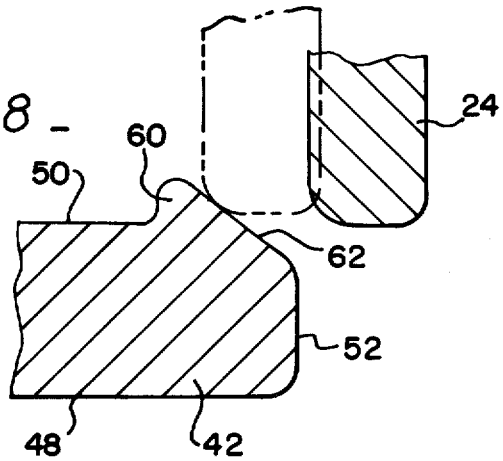
FIG. 8 is a sectional and fragmentary view of the coupler head showing another embodiment.

FIG. 8 shows a third embodiment of the invention. A rearwardly projecting and vertically extending rib 60 is formed on rear face 50 of the shelf support wall 42. Rib 60 merges with side face 52 to form a wedge-like structure having a chamfered surface 62 along the rear edge of shelf support wall 42. In practice, it has been found that when connector 24 is displaced laterally toward the knuckle side of the coupler head and contact surface 62, the angle of inclination of surface 62 tends to compel connector 24 away from wall 42 and allow connector 24 free to engage its anticreep prong with the anticreep ledge.

What is claimed is:

1. A railway coupler comprising a coupler head, said coupler head having a depending bottom shelf extending from a front face ledge, a lock movable within said coupler head between locked and released positions, a locklift means operatively connected to said lock, said locklift means having a connector means and a toggle, said connector means having one end extending therefrom to form a prong means, said bottom shelf including a vertical support portion having a chamfer facing the locklift means, and said connector means having a side face opposite said prong means, said side face having a chamfer facing the bottom shelf vertical support portion to permit said connector prong means to contact said ledge when said connector is laterally displaced.

* * * * *